US005962380A

United States Patent [19]

Tequi et al.

[11] Patent Number: 5,962,380

[45] **Date of Patent: *Oct. 5, 1999**

[54] FLUOROCARBON ELASTOMER COMPATIBILITY IMPROVING AGENT HAVING WEAR INHIBITION EFFECT

[75] Inventors: Pierre Tequi, Saint Romain de Colbosc; Jacques Cazin, Saint Martin du Manoir, both of France; Andrew W. Ho, Pinole, Calif.

[73] Assignee: Chevron Chemical Company LLC, San Francisco, Calif.

[ * ] Notice: This patent is subject to a terminal disclaimer.

[21] Appl. No.: 08/895,291

[22] Filed: Jul. 16, 1997

Related U.S. Application Data

[63] Continuation-in-part of application No. 08/676,048, Jul. 5, 1996, Pat. No. 5,807,814, which is a continuation-in-part of application No. 08/466,669, Jun. 5, 1995, Pat. No. 5,641,735.

[51] Int. Cl.[6] ..... C10M 135/00

[52] U.S. Cl. ..... 508/465; 508/197; 508/483; 508/570; 508/571

[58] Field of Search ..... 508/465, 570, 508/197

[56] References Cited

U.S. PATENT DOCUMENTS

| | | | |
|---|---|---|---|
| 2,533,233 | 12/1950 | Edwards et al. | 260/465.8 |
| 2,653,910 | 9/1953 | Airs et al. | 252/45 |
| 2,766,247 | 10/1956 | Middleton | 260/286 |
| 2,995,569 | 8/1961 | Hamilton et al. | 260/327 |
| 3,673,090 | 6/1972 | Waldbillig et al. | 252/45 |
| 3,761,596 | 9/1973 | Taninaka et al. | 424/277 |
| 3,876,550 | 4/1975 | Holubec | 252/47.5 |
| 4,007,279 | 2/1977 | Ohtsuka et al. | 424/277 |
| 4,042,514 | 8/1977 | Giolito et al. | 252/48.6 |
| 4,119,549 | 10/1978 | Davis | 252/45 |
| 4,125,479 | 11/1978 | Chesluk et al. | 252/33.6 |
| 4,147,640 | 4/1979 | Jayne et al. | 252/45 |
| 4,148,737 | 4/1979 | Liston et al. | 252/32.7 E |
| 4,191,659 | 3/1980 | Davis | 252/45 |
| 4,389,400 | 6/1983 | Ho | 424/248.52 |
| 4,427,667 | 1/1984 | Ho | 424/210 |
| 4,447,450 | 5/1984 | Ho | 424/304 |
| 4,648,985 | 3/1987 | Thorsell et al. | 252/32.5 |
| 4,859,352 | 8/1989 | Waynick | 252/41 |
| 4,879,054 | 11/1989 | Waynick | 252/41 |
| 4,880,551 | 11/1989 | Doe | 252/47.5 |
| 5,326,552 | 7/1994 | Na et al. | 424/4 |
| 5,641,735 | 6/1997 | Ho | 508/344 |

FOREIGN PATENT DOCUMENTS

| | | | |
|---|---|---|---|
| WO93/07242 | 4/1993 | WIPO | C10M 141/06 |

*Primary Examiner*—Ellen M. McAvoy
*Attorney, Agent, or Firm*—Steven G. K. Lee; E. A. Schaal

[57] ABSTRACT

The use of an effective amount of a compound as an additive improving the compatibility of a lubricating oil formulation having dispersants containing basic nitrogen atoms, with fluorocarbon elastomer seals. That compound has the formula:

(I)

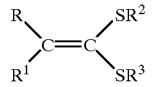

wherein R and $R^1$ are independently alkoxycarbonyl, alkenyloxycarbonyl, aryloxycarbonyl, alkylcarbonyl, alkenylcarbonyl, arylcarbonyl, or arylalkyl, or together form a carbocycle, and $R^2$ and $R^3$ are independently sulfurized alkyl, alkoxycarbonylalkyl, arylalkyl, or borated hydroxyalkyl, with the proviso that R, $R^1$, $R^2$ and $R^3$ together contain sufficient carbon atoms to render the compound oil soluble in an oil of lubricating viscosity.

16 Claims, No Drawings

FLUOROCARBON ELASTOMER COMPATIBILITY IMPROVING AGENT HAVING WEAR INHIBITION EFFECT

This is a continuation-in-part application of application Ser. No. 08/676,048, filed Jul. 5, 1996, entitled "Bis(Thio) Ethylene Ashless Wear Inhibitors And Lubricating Oils And Greases," now U.S. Pat. No. 5,807,814, which is a continuation-in-part application of application Ser. No. 08/466,669, filed Jun. 5, 1995, which issued on Jun. 24, 1997 as U.S. Pat. No. 5,641,735, entitled "Bis(Thio) Ethylene Ashless Wear Inhibitors And Lubricating Oils And Greases." Both applications (U.S. Pat. Nos. 08/466,669 and 08/676,048) are hereby incorporated by reference for all purposes.

The present invention relates to an inhibitor as an additive in lubricants to improve the compatibility with fluorocarbon elastomers. Applications can be in automotive engine oils, automotive transmission oils, specialty industrial oil packages, and the like.

BACKGROUND OF THE INVENTION

This invention relates to the improvement of the compatibility of a lubricating oil composition comprising dispersants containing basic nitrogen atoms, with fluorocarbon elastomer seals.

Lubricating oil formulations, particularly for the automotive industry, make use of a large number of additives, each having its respective role. The most important additives include detergents and dispersants, which, as their names indicate, are used to guarantee engine cleanliness and to keep in suspension the impurities produced in particular by the attack of the metallic or other parts of engines by the lubricating oil formulation.

The most widely used dispersants today are products of the reaction of succinic anhydrides substituted in the alpha positon by an alkyl chain of the polyisobutylene type (PIBSA) with a polyamine, possibly post-treated with a derivative of boron, ethylene carbonate or other post-treatment reagents known in the specialized literature. Among the polyamines used, polyalkylene-amines are preferred, such as diethylene triamine (DETA), triethylene tetramine (TETA), tetraethylene pentamine (TEPA), pentaethylene hexamine (PEHA) and heavier poly-alkylene-amines (HPA). These polyamines react with the succinic anhydrides substituted by alkyl groups of the polyisobutylene type (PIBSA) to give, according to the molar ratio of these two reagents, mono succinimides, bissuccinimides, or mixtures thereof.

These reaction products, possibly post-treated, generally have a basic nitrogen content of from 5 to 50, as measured by the base number or BN, expressed as mg KOH/g sample. This enables them to protect the metallic parts of an engine while in service from corrosion by acidic components formed as a result of the oxidation of the lubricating oil or the fuel, while keeping these oxidation products dispersed in the lubricating oil to prevent their agglomerization and their deposition in the casing containing the lubricating oil formulation.

These dispersants are even more effective if their relative basic nitrogen content is high, that is, insofar as the number of nitrogen atoms of the polyamine is larger than the number of succinic anhydride groups substituted by polyisobutenyl.

However, the higher the basic nitrogen content of these dispersants, the more they favor the attack of the fluorocarbon elastomer seals used in modern engines, because basic nitrogen tends to react with the acidic hydrogen atoms of this type of seal, and this attack results in the formation of cracks in the seal and the loss of the other desired physical properties of the fluorocarbon material from which it is made.

To resolve this dilemma, it has been proposed, according to U.S. Pat. No. 5,326,552 to Chevron, to subject the dispersants of the mono- or bissuccinimide type to a post treatment by reaction with a cyclic carbonate. Such a process not only improves the sludge dispersion in a lubricating oil containing these additives, but also the compatibility of the oil with a fluorocarbon elastomer seal.

Another solution is the subject of patent application WO 93/07242, also filed by Chevron, wherein the compatibility of a lubricating oil comprising additives containing basic nitrogen atoms with fluorocarbon elastomer seals is guaranteed by the addition of borated aromatic polyols, such as borated alkyl catechols.

Furthermore, it is well known that, in order to meet the longevity requirements demanded today in internal combustion engines, the lubricating oil formulations must contain many other ingredients, each of which has a very specific role.

Accordingly, besides the dispersants of the preceding type, other detergents are added, such as sulphonates, alkylphenates or metallic salicylates, sulphurized or not, anti oxidants, particularly zinc dialkyl dithiophosphates, antiwear and extreme pressure agents, foam inhibitors, friction reducers, rust inhibitors, corrosion inhibitors, pour point depressants, viscosity index improvers and many other additives.

SUMMARY OF THE INVENTION

The present invention is based upon our unexpected discovery that certain dithioethylene derivatives, which are useful as an antiwear and/or extreme pressure additive in lubricating oil compositions, as demonstrated in U.S. application Ser. No. 08/676,048, as discussed above, also provides improved compatibility with fluorocarbon elastomer seals in the Volkswagen PV 3344 test. They are effective from about 0.1 weight % treat rate, preferably about from 0.1 to 1.5 weight %, providing excellent compatibility with fluorocarbon elastomer seals, while yielding engine wear protection.

The dithioethylene derivatives are of the formula:

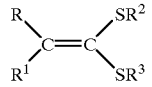

(I)

wherein R and $R^1$ are independently alkoxycarbonyl having four through thirty carbon atomsalkenyloxycarbonyl having eight through thirty carbon atoms, aryloxycarbonyl having seven through thirty carbon atoms, alkylcarbonyl having four through thirty carbon atoms, alkenylcarbonyl having eight through thirty carbon atoms, arylcarbonyl having seven through thirty carbon atoms, or arylalkyl having eight through thirty carbon atoms; or R and $R^1$, together with the carbon atom to which they are joined, form a saturated or unsaturated carbocycle having five or six carbon atoms optionally substituted with one or two alkyl groups independently having one through thirty carbon atoms, and $R^2$ and $R^3$ are independently sulfurized alkyl having three through thirty carbon atoms and at least one sulfur atoms, alkoxycarbonylalkyl wherein the alkoxy moiety has two through five carbon atoms and the alkyl moiety has one through ten carbon atoms; arylalkyl having seven through thirty carbon atoms, or borated hydroxyalkyl having two through thirty carbon atoms, with the proviso that R, $R^1$, $R^2$ and $R^3$ together contain sufficient carbon atoms to render the compound oil soluble in an oil of lubricating viscosity.

Preferably, R and $R^1$ are independently alkoxycarbonyl having eight through thirty carbon atoms.

Most preferably, R and $R^1$ are each carbo-2-ethylhexoxy and $R^2$ and $R^3$ are borated hydroxyalkyls having two through thirty carbon atoms. Preferably, $R^2$ and $R^3$ share a common boron atom, forming a cyclic structure.

As noted above, oil solubility is generally provided by the total number of carbon atoms in the R, $R^1$, $R^2$ and $R^3$ substituents. Thus, where one or more of these substituents is a small substituent, oil solubility is provided by increasing the chain length or number of carbon atoms of the other substituents.

In another aspect, the invention provides a lubricating oil composition comprising a major amount of an oil of lubricating viscosity and a fluorocarbon elastomer compatibility improving agent of the present invention.

In a further aspect, the invention provides a concentrate composition comprising about from 0.5 to 30 weight % of a fluorocarbon elastomer compatibility improving agent of the present invention and an inert hydrocarbon liquid diluent.

Additional aspects of the invention will be apparent from the following description.

DETAILED DESCRIPTION OF THE INVENTION

In its broadest aspect, the present invention involves the unexpected discovery that a novel genus of compounds which is useful as antiwear and/or extreme pressure additive in lubricating oil compositions also provides improved compatibility with fluorocarbon elastomer seals in the Volkswagen PV 3344 test.

The preferred compounds of the invention in terms of performance are the compounds of Formula I wherein R and $R^1$ are independently alkoxycarbonyl having eight to thirty carbon atoms. Preferably the R substituent is identical to the $R^1$ substituent, more preferably both R and $R^1$ are alkoxycarbonyl, most preferably both R and $R^1$ are carbo-2-ethylhexoxy. Typically, best results are obtained in terms of performance, combined with ease of manufacture, where the compounds are identically substituted with $R^2$ and $R^3$. Preferably, both $R^2$ and $R^3$ are borated hydroxyalkyl having two through thirty carbon atoms. Most preferably, $R^2$ and $R^3$ share a common boron atom, forming a cyclic structure.

DEFINITIONS

As used herein the following terms have the following meanings unless expressly stated to the contrary:

The term "alkyl" refers to both straight- and branched chain alkyl groups and includes primary, secondary and tertiary alkyl groups.

The term "alkenyl" refers to an alkyl group with unsaturation.

The term "aryl" refers to a substituted phenyl group.

The term "alkylcarbonyl" refers to the group

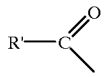

wherein R' is alkyl.

The term "alkenylcarbonyl" refers to the group

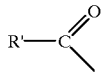

wherein R' is alkenyl.

The term "arylcarbonyl" refers to the group

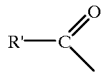

wherein R' is aryl.

The terms "alkoxycarbonyl" refer to the group

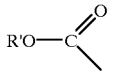

wherein R' is alkyl.

The terms "alkenyloxycarbonyl" refer to the group

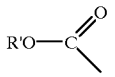

wherein R' is alkenyl.

The terms "aryloxycarbonyl" refer to the group

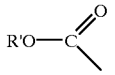

wherein R' is aryl.

The term "alkoxycarbonylalkyl" refers to the group

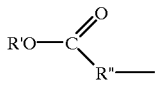

wherein R' and R" are alkyl.

The term "arylalkyl" refers to an alkyl group substituted with an aryl group.

The term "hydroxyalkyl" refers to an alkyl group substituted with an hydroxyl group.

The term "borated hydroxyalkyl" refers to the reaction product of a hydroxyalkyl with boric acid.

The term "carbocycle" refers to a saturated cyclic group with a carbon skeleton.

The term "sulfurized alkyl" refers to an alkyl group that has been substituted with sulfur.

The term "Base Number" or "BN" refers to the amount of base equivalent to milligrams of KOH in 1 gram of sample.

Thus, higher BN numbers reflect more alkaline products and therefore a greater alkalinity reserve. The BN of a sample can be determined by ASTM Test No. D2896 or any other equivalent procedure.

The term "oil solubility" means that the additive has a solubility of at least 50 grams per kilogram and preferably at least 100 grams per kilogram at 20° C. in a base lubricating oil.

The term "oil of lubricating viscosity" generally refers to an oil having a viscosity of 3–20 cSt at 100° C. in the case of lubricating oil compositions and may be a single oil or a blend of oils.

SYNTHESIS

In general the compounds of the present invention can be prepared by adapting the procedures described in U.S. Pat. Nos. 4,389,400 and 4,447,450, hereby incorporated by reference in their entirety for all purposes, by employing the appropriate starting materials corresponding to the substituent desired in the compounds of the present invention.

The compounds of Formula I wherein $R^2$ is identical to $R^3$ can be conveniently prepared by the reaction of the corresponding bis(2,2 thioate) metal salt with the corresponding halides:

(1)

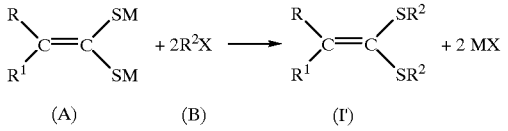

wherein R, $R^1$ and $R^2$ are as defined herementioned, X is halide, preferably chloride or bromide, or any alkylating agent with a suitable leaving group, and M is a metal cation, preferably an alkali metal, for example potassium or ammonium cation. (Also, although M is shown as a monovalent cation for the sake of simplicity, M could also be a divalent or polyvalent cation, in which case M would be represented as M/r wherein r is the valence of M).

This process can be conveniently effected by contacting Compound (A) with Compound (B), under reactive conditions, preferably in an inert organic solvent.

Typically, the process is conducted at temperatures in the range of about from −10° C. to 50° C., preferably about from 20° to 40° C., for about from 1 to 48 hours, preferably about from 4 to 8 hours, using about from 2 to 4 moles, preferably about from 2 to 2.2 moles, of (B) per mole of Compound (A). Suitable inert organic solvents which can be used include, for example, dioxane, tetrahydrofuran, dimethylformamide, toluene, methanol, and compatible mixtures thereof.

In general the compounds wherein $R^2$ and $R^3$ are the same are preferred because of the ease of preparing such compounds by the procedure described above. However, if desired, the compounds of formula I wherein $R^2$ and $R^3$ are different, or the same for that matter, can be prepared by the following process schematically represented by the following sequence of overall reaction equations:

(2)

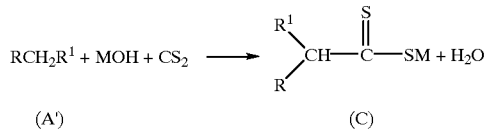

(3)

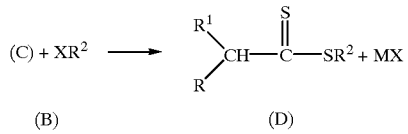

(4)

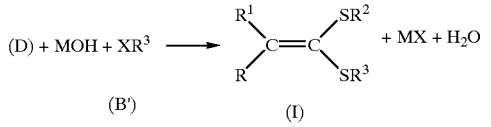

wherein R, $R^1$, $R^2$, $R^3$ and x are as defined hereinabove.

The first step in this process can be conveniently effected by contacting compound A' with an inorganic base (e.g. potassium hydroxide) and carbon disulfide under reactive conditions, preferably in an inert organic solvent.

Typically, this process step (2) is conducted at temperatures in the range of about from 0° to 50° C., preferably about from 0° to 20° C., for about from ½ to 4 hours, preferably about from 1 to 2 hours, using about from 2 to 3 equivalents, preferably about from 2 to 2.1 equivalents, inorganic base and about from 1 to 2.5 equivalents of carbon disulfide per mole of Compound (A'). Suitable inert organic bases and inert organic solvents that can be used include those already described above. Suitable inorganic bases include, for instance, sodium hydroxide, potassium hydroxide, sodium carbonate, potassium carbonate, and the like. Preferably, the reaction employs pulverized potassium hydroxide as the base in a dimethylformamide medium.

The compounds of Formulas (A') are generally known compounds and can be prepared by known procedures or by obvious modifications thereof (e.g., by using appropriately substituted starting materials).

The next reaction step (3) can be conveniently effected by contacting compound (C) with the appropriate organic halide (B) having the desired $R^2$ substituent, under reactive conditions, preferably in an inert organic solvent.

This step of this process is typically conducted at temperatures in the range of about from 0° to 100° C., preferably about from 20° to 80° C., for about from 1 to 26 hours, preferably about from 4 to 8 hours, using about from 1 to 2 moles, preferably about from 1 to 1.1 moles of compound (B) per mole of compound (C). Suitable inert organic solvents which can be used include, for example, those described with respect to reaction equation (1) used to make compounds (I'), and the like.

The last reaction step (4) can be effected by contacting compound (D) with inorganic base and compound (B') under reactive conditions, preferably in an inert organic solvent, and is conveniently conducted in situ with the reaction product mixture of the previous reaction step (3) without removal of the organic solvent. Process reaction step (4) is typically conducted at temperatures in the range of about from 0° to 100° C., preferably about from 20° to 80° C., for about from 1 to 26 hours, preferably about from 4 to 8 hours, using about from 1 to 2 equivalents, preferably about from 1 to 1.1 equivalents, of inorganic base and about from 1 to 2 equivalents, preferably about from 1 to 1.2 equivalents, of compound (B') per compound (D). Suitable inert organic bases and inert organic solvents that can be used include those already described above.

The starting materials of formula A can be prepared by the same general procedure as reaction step (2) by increasing the amount of inorganic base to produce the bis salt instead of the mono-salt:

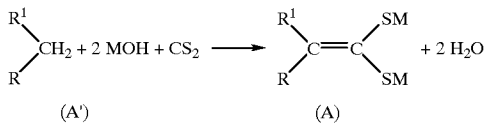

wherein R, $R^1$ and M are as defined hereinabove.

Reaction step (5) can be conveniently conducted by adding about from 2 to 2.5 equivalents of an inorganic base to the appropriate reagent A'. The reaction is done in the liquid phase employing an inert organic solvent. Suitable inert organic bases and inert organic solvents that can be used include those already described above. Preferably, the reaction employs pulverized potassium hydroxide as the base in a dioxane medium. About from 1 to 2.5 equivalents of carbon disulfide is then added to the system. The reaction is generally conducted at about from 0° to 100° C., although preferably at about from 5° to 40° C., and is generally completed from within about from 1 to 24 hours. In some instances it may be convenient to conduct reaction step in situ with the reaction product mixture produced by step (5) without removal of the solvent.

Reaction steps (2), (4) and (5) involve the addition of a solid base to an organic solvent. In order to facilitate reaction completion, a phase-transfer catalyst is preferably employed in these reactions to aid in the transfer of the solid base into the organic solvent. Preferred catalysts include, for instance, tetraalkylammonium halides. A particularly preferred catalyst is tetra-n-butylammonium bromide. In general, about 0.025 equivalents of the catalyst have been found sufficient to accomplish the catalytic effect desired. Alternatively, if the base employed is an aqueous solution, a phase-transfer catalyst is useful to facilitate transfer from the aqueous phase to the organic phase.

Reactions (3) and (4) involve adding a metallic salt (preferably potassium thiolate) to an organic medium. Preferably, in order to speed the time required for reaction, a catalytic amount (for example about 0.025 equivalents) of a phase-transfer catalyst is added. Catalysts such as tetraalkylammonium halide salts are generally preferred.

Suitable bases which can be used include those already described above. Suitable phase transfer agents are agents which transfer hydrophilic ions into a lipophilic organic medium and include, for example, benzyl triethylammonium chloride, tetra-n-butylammonium chloride, methyltrioctylammonium chloride, tetra alkylphosphonium halides, and the like.

The compounds of formula I, wherein $R^2$ and $R^3$ are sulfurized alkyl, can also be conveniently prepared by first preparing the desired $R^2$, $R^3$ olefin of formula I and reacting this compound with the desired amount of sulfur. Such sulfurization procedures are known to the art and generally involve contacting an olefin with powdered or liquid sulfur, or a sulfur equivalent, e.g. $SCl_2$, under reactive conditions at temperatures in the range of about from 80° to 110° C., typically in an inert organic solvent such as toluene.

GENERAL PROCESS CONDITIONS

In the above-described processes, it is generally preferable to separate the respective products before proceeding with the next step in the reaction sequence, except where described as an in situ step or unless otherwise expressly stated. These products can be recovered from their respective reaction product mixtures by any suitable separation and purification procedure, such as, for example, recrystallization and chromatography. Suitable separation and purification procedures are, for example, illustrated in the Examples set forth hereinbelow.

Generally, the reactions described above are conducted as liquid phase reaction and hence pressure is generally not significant except as it affects temperature (boiling point) where reactions are conducted at reflux. Therefore, these reactions are generally conducted at pressures of about from 300 to 3,000 mm of mercury and conveniently are conducted at about atmospheric or ambient pressure.

It should also be appreciated that where typical or preferred process conditions (e.g., reaction temperatures, times, mole or equivalent ratios of reactants, solvents, etc.) have been given, that other process conditions could also be used. Optimum reaction conditions (e.g., temperature, reaction time, mole ratios, solvents, etc.) may vary with the particular reagents or organic solvents used but can be determined by routine optimization procedures.

LUBRICATING OIL COMPOSITIONS

The lubricating oil compositions of the present invention can be conveniently prepared by simply blending or mixing of the compound(s) of formula I and/or an oil soluble salt thereof with an oil of lubricating viscosity (base oil). The compounds of the invention may also be preblended as a concentrate or package with various other additives in the appropriate ratios to facilitate blending of a lubricating oil composition containing the desired concentration of additives. The compounds of the present invention are blended with base oil a concentration at which they provide provides improved compatibility with fluorocarbon elastomer seals and are both soluble in the oil and compatible with other additives in the desired finished lubricating oil. Compatibility in this instance generally means that the present compounds as well as being oil soluble in the applicable treat rate also do not cause other additives to precipitate under normal conditions. Suitable oil solubility/compatibility ranges for a given compound of lubricating oil formulation can be determined by those having ordinary skill in the art using routine solubility testing procedures. For example, precipitation from a formulated lubricating oil composition at ambient conditions (about from 20° to 25° C.) can be measured by either actual precipitation from the oil composition or the formulation of a "cloudy" solution which evidences formation of insoluble wax particles.

Typically the lubricating oil composition of the invention contains about from 0.05 weight % to 5 weight %, preferably about from 0.1 weight % to 2 weight % based on the total weight of the composition, of a fluorocarbon elastomer compatibility improving agent selected from the lubricating oil soluble compounds of formula I and mixtures thereof. More preferably, the lubricating oil composition contains about from 0.2 to 1.5 weight % of the said fluorocarbon elastomer compatibility improving agent.

The lubricating oil, or base oil, used in the lubricating oil compositions of the present invention are generally tailored to the specific use e.g. automotive engine oils, automotive transmission oils, specialty industrial oil packages, etc. For example, where desired as an automotive engine oil, the base oil typically will be a mineral oil or synthetic oil of viscosity suitable for use in the crankcase of an internal combustion engine such as gasoline engines and diesel engines. The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymer of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used. Blends of various mineral oils, synthetic oils and minerals and synthetic oils may also be advantageous, for example to provide a given viscosity or viscosity range. In general the base oils or base oil mixtures for engine oil are preselected so that the final lubricating oil, containing the various additives, including the present fluorocarbon elastomer compatibility improving agent, has a viscosity at 100° C. of about from 4 to 22 centistokes, preferably about from 10 to 17 centistokes, and more preferably about from 13 to 17 centistokes.

Typically the lubricating oil composition will contain a variety of compatible additives desired to impart various properties to the finished lubricating oil composition depending on the particular end use and base oils used. Such additives include neutral and basic detergents (such as natural and overbased organic sulfonates and normal and overbased phenates and salicylates), dispersants, ashless dispersants (such as various polyalkylsuccinimides or polyalkylsuccinic acid esters), wear inhibitors (such as zinc dialkyl dithiophosphates), rust inhibitors, foam inhibitors, pour point depressants, antioxidants, viscosity index (VI) improvers, and dispersant VI improvers.

The various additive materials or classes of materials described above are known materials and can be prepared by known procedures or obvious modifications thereof and frequently are readily available from commercial sources. A listing of various additives and their function is for example described in columns 9 and 10 of U.S. Pat. No. 4,119,549 and U.S. Pat. No. 5,397,486, which are hereby incorporated by reference.

The present invention also provides an additive package or concentrate which may be added to an oil of lubricating viscosity either as the sole additive or in combination with other additives. (Generally, the additive package will not contain a viscosity index improver because even where desired the viscosity index improver is generally added to the base oil by the lubricant formulator.) Thus, a preferred additive concentrate contains about from 0.5 to 30 weight %, more preferably about from 1 to 20 weight % of the fluorocarbon elastomer compatibility improving agent of the present invention; sufficient ashless dispersant to provide adequate dispersancy; and about from 90 to 10 weight % of a diluent oil or other compatible inert organic liquid diluent. With the general exception of the VI improver, the concentrate will also frequently contain about from 10 to 60 weight % of various other additives considered desirable from the intended use.

In one embodiment, a lubricating oil composition would contain (a) a major amount of a base oil of lubricating viscosity;
(b) about from 1 to 20 weight % of at least one ashless dispersant;
(c) from 0 to about 20 weight % of at least one detergent;
(d) about from 0.05 to 5 weight % of at least one zinc dithiophosphate;
(e) from 0 to about 10 weight % of at least one oxidation inhibitor;
(f) from 0 to about 1 weight % of at least one foam inhibitor;
(g) from 0 to about 20 weight % of at least one viscosity index improver; and
(h) about from 0.05 to 5 weight % of at least one fluorocarbon elastomer compatibility improving agent of the present invention.

A lubricating oil composition can be produced by blending together a major amount of a base oil of lubricating viscosity, about from 1 to 20 weight % of at least one ashless dispersant, from 0 to about 20 weight % of at least one detergent, about from 0.05 to 5 weight % of at least one zinc dithiophosphate, from 0 to about 10 weight % of at least one oxidation inhibitor, from 0 to about 1 weight % of at least one foam inhibitor, from 0 to about 20 weight % of at least one viscosity index improver; and about from 0.05 to 5 weight % of at least one fluorocarbon elastomer compatibility improving agent of the present invention. The lubricating oil composition produced by that method might have a slightly different composition, as components interact.

PREPARATIONS AND EXAMPLES

A further understanding of the invention can be had in the following nonlimiting Preparations and Examples. Unless expressly stated to the contrary, all temperatures and temperature ranges refer to the Centigrade system and the term "ambient" or "room temperature" refers to 20° C. to 25° C. The term "percent" or "%" refers to weight percent and the term "mole" or "moles" refers to gram moles. The term "equivalent" refers to a quantity of reagent equal in moles, to the moles of the preceding or succeeding reactant recited in that example in terms of finite moles or finite weight or volume. Where given, proton-magnetic resonance spectrum (p.m.r. or n.m.r.) were determined at 300 mHz, using trimethylsilene deuterated chloroform signals are assigned as singlets (s), broad singlets (bs), doublets (d), double doublets (dd), triplets (t), double triplets (dt), quartets (q), and multiplets (m), and ppm refers to part per million.

EXAMPLE 1

BORATED 1,1-BIS(2-HYDROXYETHYLTHIO)-2,2-BIS(CARBO-2-ETHYLHEXOXY)ETHYLENE

A mixture (suspension) of 1010 g (2.05 mole) of 1,1-Bis(2-hydroxyethylthio)-2,2-bis(carbo-2-ethylhexoxy)ethylene and 253 g (4.1 moles) of Boric Acid was stirred in 2500 ml of Toluene in a 5 L flask equipped with a Dean Stark Trap and condenser and under Nitrogen Blanket. The mixture was heated to 95° C. and stirred vigorously for 3 hours. The mixture was then heated to reflux (108–115° C.) and water was collected from the azeotropic fraction (72 ml in 5 hr.). The mixture was then cooled and filtered to remove excess Boric Acid. The filtrate was evaporated to yields 1026 g of a clear gold colored oil as the title compound; NMR at 0.83 ppm (t, 12H), 1.20–1.65 ppm (m, 18H), and 3.10–4.15 ppm (m, 9H).

EXAMPLE 2

1,1 -DI (ETHOXYCARBONYLMETHYLENETHIO)-2,2-BIS(CARBO-2-ETHYLHEXOXY)ETHYLENE

In this example 246.2 grams (2.0 moles) ethyl chloroacetate was added to 1.03 moles of dipotassium 2,2-bis(carbo- 2-ethylhexoxy)-1,1-dithiolate in 1000 ml of dimethyl formamide at 100° C. under a nitrogen atmosphere. The mixture was stirred vigorously for 72 hours and then filtered to remove the potassium chloride byproduct. The filtrate was then evaporated to remove the dimethyl formamide solvent and the residue was dissolved in methylene chloride. The methylene chloride solution was washed several times with water, then dried with an anhydrous magnesium sulfate and evaporated to dryness to remove the methylene chloride solvent. The resulting residue was dissolved in hexane, then passed through a silica gel filter with a 15% by volume ethyl acetate-hexane solution. The filtrate was evaporated under vacuum affording 420.1 grams of an oil residue. The structure of the title compound was confirmed by infrared spectra and nuclear magnetic resonance spectra; NMR at 0.88 ppm (t, 12H), 1.10–1.80 ppm (m, 22H), and 3.35–4.40 ppm (m, 12H).

By applying the above procedure using the appropriate starting materials the following compounds can be prepared: 1,1-di(t-butoxycarbornylmethylthio)-2,2-bis(carbo-2-ethylhexoxy)ethylene; 1,1-di(propoxycarbornylmethylthio)-2,2-bis(carbo-2-ethylhexoxy)ethylene; 1,1-di(hexoxycarbornylmethylthio)-2,2-bis(carbo-2-ethylhexoxy)ethylene; 1,1 di(benzyloxycarbornylmethylthio)-2,2-bis(carbo-2-ethylhexoxy)ethylene; and 1,1-di(p-tolyloxycarbornylmethylthio)-2,2-bis(carbo-2 ethylhexoxy)ethylene.

EXAMPLE 3

1,1-BIS(SULFURIZEDPROPYLTHIO)-2,2-BIS(CARBO-2-ETHYLHEXOXY)ETHYLENE

In this example a mixture containing 72.4 grams (4.15 moles) of 1,1 di(allythio)-2,2-bis(2-carbo-2-ethylhexoxy)ethylene and 10.1 grams of powdered sulfur dissolved in 250 ml. of ethylene was heated at reflex (about 136°–144° C.) with stirring for 24 hours. The mixture was then cooled, dissolved in a 95:5 by volume hexane:ethyl acetate mixture and then filtered through silica gel. The filtrate was evaporated to dryness under vacuum affording 81.9 grams of the title compound as a brown oil residue; NMR at 0.85 ppm (t, 12H), 1.30–1.65 ppm (m, 22H), 2.10–3.30 ppm (m, 2H), and 3.85–4.20 ppm (m, 4H).

Similarly by applying the above procedure using the corresponding appropriate unsulfurized olefins starting materials the following compounds can be respectively prepared:
1,1-bis(sulfurizedbutylthio)2,2-bis(carbo-2-ethylhexoxy)ethylene; 1,1 bis(sulfurizedpentylthio)2,2-bis(carbo-2-ethylhexoxy)ethylene; 1,1 bis(sulfurizedisobutyl)2,2-bis(carbo-2-ethylhexoxy)ethylene; 1,1 bis(3 phenyl-sulfurizedpropylthio)2,2-bis(carbo-2-ethylhexoxy)ethylene; and 1,1-bis(3-tolyl-sulfurizedpropylthio)2,2-bis(carbo-2-ethylhexoxy)ethylene.

EXAMPLE 4

1,1-DIBENZYLTHIO-2,2-BIS(CARBO-2-ETHYLHEXOXY)ETHYLENE

A 126.6 g (1.0 mole) of Benzyl chloride was added dropwise to a mixture of 240.4 g (0.5 mole) of Dipotassium 2,2-bis(carbo-2-ethylhexoxy)-1,1 dithiolate in 500 ml of Dimethyl formamide at 100° C. under nitrogen atmosphere. The mixture was then heated and stirred vigorously for 72 hours. Upon cooling, the mixture was filtered to remove potassium chloride by product. The filtrate was then evaporated to remove solvent. The remaining dark brown oil was dissolved in hexane and then washed several times with water. The Organic phase was then dried with anhydrous Magnesium sulfate, filtered, and stripped on a Rotovap to yield 249.6 g of a dark red oil. The oil was dissolved in hexane and passed through a short path Silica gel pack on a filter funnel with hexane to remove unreacted Benzyl chloride and then eluted with 25% Ethyl acetate/Hexane solvent. The ethyl acetate/hexane solution was then evaporated to yield 212 g of a dark red oil as the title compound, NMR at 0.81 ppm (t, 12H), 1.2–1.65 ppm (m, 18H), 4.10 ppm (m, 4H), 4.60 ppm(s, 4H), and 7.20–7.40 ppm (m, 10H).

EXAMPLE 5

PASSENGER CAR ENGINE OIL

In this example, the title compounds of Examples 1–4 were respectively formulated into two separate finished lubricating oils, at concentrations of 0.2 weight %, 0.5 weight %, and 1.0 weight %. The finished lubricating oils contained amounts of ashless dispersants typical of a passenger car engine oil, and small amounts of standards detergents, zinc dithiophosphates, oxidation and foam inhibitors, standard viscosity index improvers and base oils of lubricating viscosity to simulate commercial finish lubricating oils.

The representative formulations were tested for fluorocarbon elastomer compatibility by the VW PV 3344 test and compared with the identical lubricating oil without the fluorocarbon elastomer compatibility improving agent of the present invention.

The tested compounds improved the tensile strength at break (TSB), improved the elongation at break (ELB), and produced less cracks on the elastomer dumbbell.

The formulations were also evaluated in a laboratory bench test called the blotter spot test. The tested compounds did not have any detrimental effect on the dispersant credit of the dispersant/inhibitor package, measured by that blotter spot test. This paper chromatography technique measures the ability of the candidate lubricating oil to maintain artifical contaminates in suspension. The metric is a rating of degree of dispersion for six different spots, leading to a rating of up to 600, The higher the number, the better the dispersant credit. The results for the PV 3344 test and the blotter spot test are reported in Table 1 (first fully formulated oil) and Table 2 (second fully formulated oil).

TABLE 1

First Finished Lubricating Oil

| Example | Concentration (wt %) | Blotter spot test rating/600 | PV 3344 test TSB | ELB | Cracks yes/no (number of cracks) |
|---|---|---|---|---|---|
| Reference | | 447 | 7.4 | 149 | yes (>100) |
| 1 | 0.2 | | 7.6 | 156 | yes (11) |
| | 0.5 | 458 | 8.3 | 168 | no |
| | 1 | 456 | 9 | 180 | no |
| 2 | 0.2 | | 7.5 | 155 | yes (41) |
| | 0.5 | 437 | 7.6 | 159 | yes (35) |
| | 1 | 431 | 8.3 | 174 | no |
| 4 | 0.2 | | 7.7 | 157 | yes (39) |
| | 0.5 | 451 | 7.2 | 147 | yes (11) |
| | 1 | 446 | 7.6 | 151 | no |

TABLE 2

Second Finished Lubricating Oil

| Example | Concentration (wt %) | PV 3344 test TSB | ELB | Cracks yes/no (number of cracks) |
|---|---|---|---|---|
| Reference | | 7.7 | 142 | yes (>20) |
| 1 | 0.5 | 9.3 | 169 | no |
| | 1 | 9.6 | 174 | no |
| 2 | 0.5 | 8.7 | 158 | no |
| | 1 | 8.5 | 167 | no |
| 3 | 0.5 | 8.5 | 152 | no |
| | 1 | 8.2 | 147 | no |
| 4 | 0.5 | 8.2 | 149 | no |
| | 1 | 8.3 | 150 | no |

EXAMPLE 6

HIGH PERFORMANCE DIESEL OIL AND SUPER HIGH PERFORMANCE DIESEL OIL

In this example, the title compounds of Examples 1–4 were respectively formulated into two separate finished lubricating oils, as in Example 5, except that the finished lubricating oils contained amounts of ashless dispersants typical of a high performance diesel oil (HPDO) and a super high performance diesel oil (SHPDO), instead of a passenger car engine oil. Formulations were also made at the 1.5 weight % concentration.

The results are shown below in Tables 3 (HPDO) and 4 (HPDO).

TABLE 3

High Performance Diesel Lubricating Oil

| Example | Concentration (wt %) | Blotter spot test rating/600 | PV 3344 test TSB | ELB | Cracks yes/no (number of cracks) |
|---|---|---|---|---|---|
| Reference | | 458 | 6.9 | 149 | yes (>100) |
| 1 | 0.2 | | 7.1 | 154 | yes (98) |
| | 0.5 | 465 | 7.8 | 158 | yes (27) |
| | 1 | 474 | 8.8 | 179 | no |
| 2 | 0.2 | | 7 | 149 | yes (94) |
| | 0.5 | 461 | 7.8 | 158 | yes (27) |
| | 1 | 453 | 8 | 164 | no |
| 4 | 0.2 | | 6.9 | 148 | yes (100) |
| | 0.5 | 461 | 6.8 | 146 | yes (27) |
| | 1 | 467 | 7.7 | 155 | yes (14) |

TABLE 4

Super High Performance Diesel Lubricating Oil

| Example | Concentration (wt %) | Blotter spot test rating/600 | PV 3344 test TSB | ELB | Cracks yes/no (number of cracks) |
|---|---|---|---|---|---|
| Reference | | 458 | 6.6 | 128 | yes (crack/break) |
| 1 | 1 | 469 | 8.2 | 160 | yes (14) |
| | 1.5 | 480 | 8.7 | 172 | no |

While the present invention has been described with reference to specific embodiments, this application is intended to cover those various changes and substitutions that may be made by those skilled in the art without departing from the spirit and scope of the appended claims.

What is claimed is:

1. A method for improving the compatibility with fluorocarbon elastomer seals of a lubricating oil formulation comprising dispersants containing basic nitrogen atoms, said method comprising either blending or mixing with said lubricating oil formulation an effective amount of a compound having the formula:

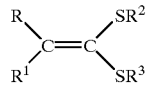

(I)

wherein R and $R^1$ are independently:

(a) alkoxycarbonyl having four through thirty carbon atoms, (b) alkenyloxycarbonyl having eight through thirty carbon atoms, (c) aryloxycarbonyl having seven through thirty carbon atoms, (d) alkylcarbonyl having four through thirty carbon atoms, (e) alkenylcarbonyl having eight through thirty carbon atoms, (f) arylcarbonyl having seven through thirty carbon atoms, (g) arylalkyl having eight through thirty carbon atoms, or R and $R^1$ together with the carbon atom to which they are joined form:

(h) a saturated or unsaturated carbocycle having five or six carbon atoms optionally substituted with one or two alkyl groups independently having one through thirty carbon atoms, and $R^2$ and $R^3$ are independently:

(i) sulfurized alkyl having three through thirty carbon atoms and at least one sulfur atom, (j) alkoxycarbonylalkyl wherein the alkoxy moiety has two through five carbon atoms and the alkyl moiety has one through ten carbon atoms;

(k) arylalkyl having seven through thirty carbon atoms, or (l) borated hydroxyalkyl having two through thirty carbon atoms, with the proviso that R, $R^1$, $R^2$ and $R^3$ together contain sufficient carbon atoms to render the compound oil soluble in an oil of lubricating viscosity.

2. The method according to claim 1 wherein R and $R^1$ are independently alkoxycarbonyl having eight to thirty carbon atoms.

3. The method according to claim 2 wherein the R substituent is identical to the $R^1$ substituent.

4. The method according to claim 2 wherein the $R^2$ substituent is identical to the $R^3$ substituent.

5. The method according to claim 4 wherein the R substituent is identical to the $R^1$ substituent.

6. The method according to claim 3 wherein R and $R^1$ are each carbo-2-ethylhexoxy.

7. The method according to claim 6 wherein $R^2$ and $R^3$ are borated hydroxyalkyls having two through thirty carbon atoms.

8. The method according to claim 7 wherein $R^2$ and $R^3$ share a common boron atom, forming a cyclic structure.

9. A lubricating oil formulation comprising dispersants containing basic nitrogen atoms that has had its compatibility with fluorocarbon elastomer seals improved by the method of claim 1.

10. A lubricating oil formulation comprising:

(a) a major amount of a base oil of lubricating viscosity;

(b) about from 1 to 20 weight % of at least one ashless dispersant;

(c) from 0 to 20 weight % of at least one detergent;

(d) about from 0.05 to 5 weight % of at least one zinc dithiophosphate;

(e) from 0 to 10 weight % of at least one oxidation inhibitor;

(f) from 0 to 1 weight % of at least one foam inhibitor;

(g) from 0 to 20 weight % of at least one viscosity index improver; and (h) about from 0.05 to 5 weight % of at least one fluorocarbon elastomer compatibility improving agent of the formula (I)

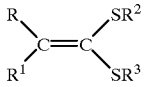

wherein R and $R^1$ are independently:

(1) alkoxycarbonyl having four through thirty carbon atoms, (2) alkenyloxycarbonyl having eight through thirty carbon atoms, (3) aryloxycarbonyl having seven through thirty carbon atoms, (4) alkylcarbonyl having four through thirty carbon atoms, (5) alkenylcarbonyl having eight through thirty carbon atoms, (6) arylcarbonyl having seven through thirty carbon atoms, or (7) arylalkyl having eight through thirty carbon atoms, or R and $R^1$ together with the carbon atom to which they are joined form:

(8) a saturated or unsaturated carbocycle having five or six carbon atoms optionally substituted with one or two alkyl groups independently having one through thirty carbon atoms, and $R^2$ and $R^3$ are independently:

(9) sulfurized alkyl having three through thirty carbon atoms and at least one sulfur atom,

(10) alkoxycarbonylalkyl wherein the alkoxy moiety has two through five carbon atoms and the alkyl moiety has one through ten carbon atoms;

(11) arylalkyl having seven through thirty carbon atoms, or

(12) borated hydroxyalkyl having two through thirty carbon atoms, with the proviso that R, $R^1$, $R^2$ and $R^3$ together contain sufficient carbon atoms to render the compound oil soluble in an oil of lubricating viscosity.

11. The lubricating oil composition according to claim 10 wherein R and $R^1$ are each carbo-2-ethylhexoxy.

12. The lubricating oil composition according to claim 11 wherein $R^2$ and $R^3$ are borated hydroxyalkyls having two through thirty carbon atoms.

13. The lubricating oil composition according to claim 12 wherein $R^2$ and $R^3$ share a common boron atom, forming a cyclic structure.

14. A concentrate comprising about from 10 weight % to 90 weight % of a compatible organic liquid diluent and about from 0.5 weight % to 30 weight % of a compound having the formula:

(I)

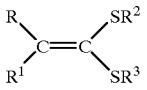

wherein R and $R^1$ are independently:

(a) alkoxycarbonyl having four through thirty carbon atoms, (b) alkenyloxycarbonyl having eight through thirty carbon atoms, (c) aryloxycarbonyl having seven through thirty carbon atoms, (d) alkylcarbonyl having four through thirty carbon atoms, (e) alkenylcarbonyl having eight through thirty carbon atoms, (f) arylcarbonyl having seven through thirty carbon atoms, or (g) arylalkyl having eight through thirty carbon atoms, or R and $R^1$ together with the carbon atom to which they are joined form:

(h) a saturated or unsaturated carbocycle having five or six carbon atoms optionally substituted with one or two alkyl groups independently having one through thirty carbon atoms, and $R^2$ and $R^3$ are independently:

(i) sulfurized alkyl having three through thirty carbon atoms and at least one sulfur atom, (j) alkoxycarbonylalkyl wherein the alkoxy moiety has two through five carbon atoms and the alkyl moiety has one through ten carbon atoms;

(k) arylalkyl having seven through thirty carbon atoms, or (l) borated hydroxyalkyl having two through thirty carbon atoms, with the proviso that R, $R^1$, $R^2$ and $R^3$ together contain sufficient carbon atoms to render the compound oil soluble in an oil of lubricating viscosity.

15. A method of producing a lubricating oil composition comprising blending the following components together:

(a) a major amount of a base oil of lubricating viscosity;

(b) about from 1 to 20 weight % of at least one ashless dispersant;

(c) from 0 to 20 weight % of at least one detergent;

(d) about from 0.05 to 5 weight % of at least one zinc dithiophosphate;

(e) from 0 to 10 weight % of at least one oxidation inhibitor;

(f) from 0 to 1 weight % of at least one foam inhibitor;

(g) from 0 to 20 weight % of at least one viscosity index improver; and (h) about from 0.05 to 5 weight % of at least one fluorocarbon elastomer compatibility improving agent of the formula

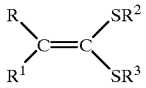

(I)

wherein R and $R^1$ are independently:

(1) alkoxycarbonyl having four through thirty carbon atoms, (2) alkenyloxycarbonyl having eight through thirty carbon atoms, (3) aryloxycarbonyl having seven through thirty carbon atoms, (4) alkylcarbonyl having four through thirty carbon atoms, (5) alkenylcarbonyl having eight through thirty carbon atoms, (6) arylcarbonyl having seven through thirty carbon atoms, or (7) arylalkyl having eight through thirty carbon atoms, or R and $R^1$ together with the carbon atom to which they are joined form:

(8) a saturated or unsaturated carbocycle having five or six carbon atoms optionally substituted with one or two alkyl groups independently having one through thirty carbon atoms, and $R^2$ and $R^3$ are independently:

(9) sulfurized alkyl having three through thirty carbon atoms and at least one sulfur atom,

(10) alkoxycarbonylalkyl wherein the alkoxy moiety has two through five carbon atoms and the alkyl moiety has one through ten carbon atoms;

(11) arylalkyl having seven through thirty carbon atoms, or

(12) borated hydroxyalkyl having two through thirty carbon atoms, with the proviso that R, $R^1$, $R^2$ and $R^3$ together contain sufficient carbon atoms to render the compound oil soluble in an oil of lubricating viscosity.

16. A lubricating oil composition produced by the method according to claim 15.

* * * * *